US008439599B2

(12) United States Patent
Schmidt

(10) Patent No.: US 8,439,599 B2
(45) Date of Patent: May 14, 2013

(54) SEALANT DISPENSER AND SPREADER

(76) Inventor: Leroy Schmidt, Louisburg, KS (US)

( * ) Notice: Subject to any disclaimer, the term of this patent is extended or adjusted under 35 U.S.C. 154(b) by 0 days.

(21) Appl. No.: 13/444,549

(22) Filed: Apr. 11, 2012

(65) Prior Publication Data

US 2012/0257927 A1 Oct. 11, 2012

Related U.S. Application Data

(60) Provisional application No. 61/473,900, filed on Apr. 11, 2011.

(51) Int. Cl.
*E01C 23/02* (2006.01)

(52) U.S. Cl.
USPC ..... 404/107; 404/111; 118/108

(58) Field of Classification Search ..... 404/101, 404/107, 108, 110, 111; 222/160, 185.1; 118/100, 108
See application file for complete search history.

(56) References Cited

U.S. PATENT DOCUMENTS

| | | | | | |
|---|---|---|---|---|---|
| 791,726 | A | * | 6/1905 | Schutte | 401/48 |
| 1,052,578 | A | * | 2/1913 | Fitzgerald | 404/107 |
| 1,139,844 | A | * | 5/1915 | Calnan | 404/107 |
| 1,751,565 | A | | 3/1930 | Talbott | |
| 1,910,650 | A | * | 5/1933 | Tarrant | 222/470 |
| 2,317,843 | A | * | 4/1943 | Backlund | 15/50.1 |
| 2,847,689 | A | * | 8/1958 | Miller | 401/48 |
| 3,416,710 | A | | 12/1968 | Roubal | |
| 4,492,490 | A | | 1/1985 | Christine et al. | |
| 4,532,882 | A | * | 8/1985 | Ciraud | 118/108 |
| 4,575,279 | A | * | 3/1986 | Mateja | 404/111 |
| 4,630,965 | A | | 12/1986 | Nguyen et al. | |
| 4,653,424 | A | | 3/1987 | Schloss | |
| 4,725,163 | A | * | 2/1988 | Phillips | 404/101 |
| 4,732,109 | A | * | 3/1988 | Selby | 118/713 |
| 4,831,958 | A | * | 5/1989 | Selby | 118/108 |
| 5,254,167 | A | * | 10/1993 | Janoski et al. | 118/108 |
| 5,735,952 | A | * | 4/1998 | Wilson, Sr. | 118/100 |
| 6,050,744 | A | * | 4/2000 | Binning | 404/108 |
| 6,290,428 | B1 | | 9/2001 | Hall et al. | |
| 6,540,423 | B1 | * | 4/2003 | Kugler et al. | 401/48 |
| 6,817,798 | B2 | * | 11/2004 | Kugler et al. | 401/48 |
| 2004/0045444 | A1 | | 3/2004 | Mann | |
| 2005/0229844 | A1 | | 10/2005 | Leach et al. | |

* cited by examiner

*Primary Examiner* — Gary Hartmann
(74) *Attorney, Agent, or Firm* — Intellectual Property Center, LLC; Arthur K. Shaffer

(57) ABSTRACT

The present invention is directed to a combination sealant dispensing and spreading apparatus for selectively dispending and spreading sealant upon a paved surface, the apparatus comprising a moveable frame having a lower support, a sealant tank the lower support operably connected to a V-shaped spreading means for spreading sealant from the tank upon the paved surface.

10 Claims, 8 Drawing Sheets

SEALANT DISPENSER AND SPREADER

FIELD OF THE INVENTION

The present invention relates to spreader devices and more particularly to a sealant dispenser device which dispenses and spreads a sealant selectively along a paved surface.

BACKGROUND OF THE INVENTION

The importance of maintaining the surface of highways, driveways, parking lots, and airports is important. Many businesses rely upon integrity of paved surfaces. However, if not maintained properly, the integrity may be compromised leading to catastrophic failure of the paved surface. Generally, when asphalt or other paving materials are laid down as a new product or as an overlay, it begins to deteriorate immediately under ambient conditions like, the weather, bearing loads e.g. trucks, cars, airplanes, construction equipment along with changing underground conditions like erosion, contour shifting and ground or underground water. Eventually, if the pavement is not cared for properly, it will fail, forming cracks of different sizes. Water infiltration is a common cause of crack formation. This is particularly troublesome when the cracks form along the interior paved surface. Cracks located within the interior paved surface tend to accelerate degeneration of the paved surface and may ultimately result in structural failure. Therefore, it is important to maintain the integrity of the paved surface, including minimizing the impact of ground or underground water.

If the asphalt has not been maintained properly traffic or any other asphalt load bearing condition may more easily lead to cracks within the asphalt or may provide a weakened condition conducive to crack formation.

Seams formed in the asphalt laying process may constitute another problem. Due to freezing, temperature change, or excess water allowed through the seams as well as other weather phenomena, the seam may eventually (within a year or two), depending on the sub-base, open up and leave a crack in the asphalt which usually runs along the seam. If the crack in the seam is not sealed within a reasonable period of time, water (from rain, snow, and other precipitation) may find its way underneath the asphalt between the layers of the asphalt. Changes in temperature, i.e., intermittent freezing and thawing, destruct the asphalt frames which also advances the deterioration process of the asphalt.

It is a known practice to fill cracks with sealers to repair the cracks in order to prevent further deterioration of the asphalt. Products such as commercially available rubberized asphalt, silicone rubber, coal tar, PVC, and neoprene have been used to repair cracks in pavements. Among the many techniques for sealing cracks in pavement two main methods have been typically used.

One of the commercially used methods is a hot pour crack filling, where a sealing compound is heated and melted from a relatively solid brick state into a liquid state and maintained in a container with an oil jacket to insulate against heat loss. Being in a liquid stage the sealer is pumped into the crack through a hose and is applied around the crack as well as over the crack area. The machines for applying sealant to the crack using the hot pour crack filling method are relatively expensive, with the cost possibly ranging from $5,000.00 to $25,000.00. The process is extremely time consuming, because it takes about an hour to an hour and a half to heat the block of sealer to transform it into a liquid form, then the liquefied sealant must be repeatedly transferred to a dispensing container and manually dispensed to the paved surface typically by hand or with a hose or machine having limited maneuverability. Because of the weight and heat of any handheld machines, the application of the crack sealer can be dangerous and time consuming.

Some crack sealers are maintained and dispersed at very high temperatures. In addition, as the crack sealer is dispensed, it often overflows or otherwise attaches to sidewalls of the machinery and is difficult to remove from associated surfaces. Because many crack sealers are combustible, one way to remove the undesired crack sealer involves combustion with an igniter such as a torch directed to the attached material. However, many machines may include materials which are not designed to sustain combustion necessary to remove the attached material and may inadvertently burn or become damaged. Therefore, there exists a need for a sealant dispenser which can withstand elevated temperatures.

A material which can sustain the elevated temperature is carbon steel. However, combined with the weight of the sealant and the weight of the steel, may cause difficulty for maneuvering the machine or otherwise transport it to areas necessary for repair or treatment of the paved surface. In addition, the terrain associated with the paved surface may be irregular as the paved surface has eroded. Centering the weight of the contained sealant and the balance of the machine may be important in avoiding accidents as the machine traverses the irregular surface. The machines ability to distribute the load over multiple wheels may be desirable. Difficulty in maneuverability and weight may increase the time necessary for repair or treatment of the paved surface which can also lead to increased costs and decreased efficiencies as well as additional safety issues related to working with the hot combustible material. Therefore, there exists a need for an easy to maneuver sealant dispenser which is adapted for traversing difficult terrain.

Crack sealing machines come in a variety of different styles, types, designs, and dollar factors. For example, a crack sealer machine, described in U.S. Pat. No. 6,290,428 includes a wheeled, supporting frame and a container for holding crack filler. U.S. Pat. No. 4,653,424 includes a wheeled support frame with a tank for dispensing the contained crack filling medium and a squeegee operably connected to handle for spreading the dispensed crack filler. Another machine for dispensing sealant into cracks in pavement, described in U.S. Pat. No. 4,575,279, includes a container mounted on a movable frame. The container has a dispensing opening in a bottom wall and a valve assembly in the container itself to control flow of sealant from the container. A roller and squeegee are mounted under the container for spreading the material after it has been dispensed. However, each of these machines had disadvantages which are addressed by the present invention, a sealant dispenser for dispensing and selectively spreading the sealant on the paved surface.

SUMMARY OF THE INVENTION

The present invention is directed to a combination sealant dispensing and spreading apparatus for selectively dispensing and spreading sealant upon a paved surface said apparatus comprising a moveable frame having a handle extending angularly towards a lower support, a sealant tank having a sidewall extending downwardly toward a channeled guide and in operation with a dispensing means, said lower support operably connected to a V-shaped spreading means, said handle having a pair of operators a first handle operator and a second handle operator, said first handle operator in communication with the dispensing means and said second handle operator in communication with the spreading means, said first handle operator being biased for retaining the sealant within said sealant tank and when operated, said first handle operator selectively releases the sealant from said tank, and said second handle operator being biased for engagement of said spreading means with said paved surface for spreading the sealant dispensed from said tank upon the paved surface.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, (but merely as a basis for the claims) and as a representative basis for teaching one skilled in the art to variously employ the present invention in virtually any appropriately detailed structure.

Figure 1:
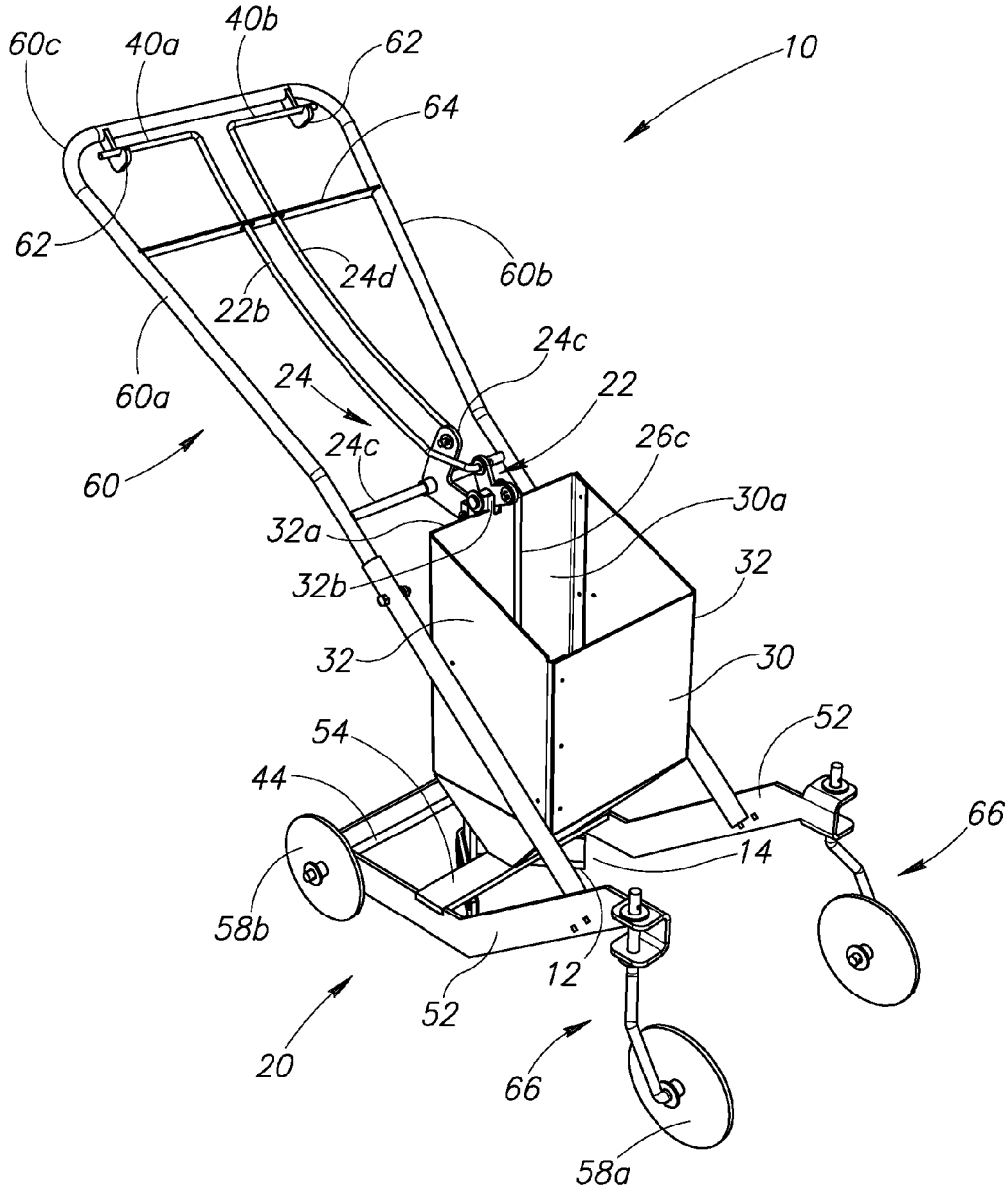
FIG. 1 is a front side perspective view of an exemplary embodiment of a sealant dispensing and spreading apparatus and method in accordance with the present invention.

FIG. 1 illustrates an exemplary embodiment of the sealer dispenser and spreading apparatus generally referred to herein as reference numeral 10 which advantageously includes a movable frame 20 with lower support 50, a handle 60 extending upwardly therefrom, a (sealant) tank 30, spreading means 24 associated with the lower support 50, dispensing means 22 associated with the tank 30, each of said spreading and dispensing means 24, 22 being operationally associated with the handle 60 for selective dispensing and spreading of any sealant (not shown) from the tank 30 to the paved surface (also not shown).

As illustrated the tank 30 includes a sidewall 32 extending downwardly toward a channeled guide 36. In the illustration, the dispensing means 22 includes a plunger 34 engageably received by the channeled guide 36. The dispensing means 22, as illustrated in FIG. 2E, includes a plunger 34 extending downwardly from a dispensing arm 22*a* towards the channeled guide 36 for selective release of the sealant to the paved surface. A pair of plunger guides 34*a*, 34*b* is utilized for alignment of the plunger 34 within the channel guide 36 between an engaging and a elevated position. Each guide 34*a*, 34*b* is illustrated with a pair of tabs 34*c* presenting a slotted opening 34*d* for slidable receipt of a dispensing linking member 22*b* positioned between the dispensing arm 22*a* and the plunger 34.

The dispensing arm 22*a* being generally associated with a rear wall 30*a* associated with the tank 30 rotates about a dispensing shaft 22*c* extending horizontally along an upper lip 32*a* of the rear wall 30*a*, the upper lip 32*a* having a pair of vertical supports 32*b* adapted for receipt and support of the shaft 22*c* for rotation of the dispensing arm 22*a*. The plunger 34 moves between the engaging position towards the elevated position as the dispensing arm 22*a* rotates about the shaft 22*c*, the dispensing arm 22*a* being generally biased towards the engaging position.

A pair of operators, a first handle operator and a second handle operator. The first handle operator also referred to herein as a first control member 40*a* is in communication with a second end 22*e* of the dispensing arm 22*a* and is secured by a catch 62 extending from said handle 60. Selective operation of the first control member 40*a* adjusts the volumetric distribution of the sealant from the apparatus 10, allowing the operator to control the amount of dispensed sealant. Simultaneous with the operation of the first control member 40*a*, the second handle operator also referred to herein as a second control member 40*b* is in communication with the spreading arm 24*a* and is adapted for selective operation of the spreading means 24, the second control arm 40*b* being additionally adapted for receipt by the catch 62.

In operation, the dispensing arm 22*a* is rotated about the shaft 22*c* as the first control member 40*a* is compressed away from the tank 30. As the first control member 40*a* is selectively operated, the plunger 34 operates between the engaging position towards the elevated position. Sufficient linking members are provided between the first control member 40*a* and the dispensing arm 22*a* and between the second control member 40*b* and the spreading arm 24*a* for operation of the sealant dispenser and spreader apparatus 10. Although illustrated as rods, the linking members may alternatively utilize wires, cables or the like.

The spreading means 24, as illustrated, includes a V-shaped squeegee 12 extending downwardly from the channeled guide 36 towards the paved surface. The squeegee 12 is in communication with a lifting rod 26 for selectively raising and lowering the squeegee 12 as desired for spreading the dispensed sealant upon the paved surface. The lifting rod 26 is operationally connected to a first end 24*b* of the spread engaging arm 24*a* and is in communication with a spreader linkage member 24*d* which is secured to a second end 24*c* of the spread engaging arm 24*a*. The second end 24*c* is in communication with the second control member 40*b* adapted for receipt by the catch 62.

In operation, as the second control member 40*b* is selectively operated, the spread engaging arm 24*a* is rotated about a laterally extending shaft 24*e* which extends horizontally between a pair of opposing side handles 60*a*, 60*b*. As the second control member 40*b* compresses, the spread engaging arm 24*a* rotates between an inclined to a reclined position for raising and lowering the lifting rod 26 associated with the squeegee 12.

The handle 60 includes a u-shaped handle 60*c* telescopically received by a pair of outer sleeves 60*d*, the u-shaped handle 60*c* and outer sleeves 60*d* being mechanically fastened for optional telescopic adjustment. One end of each outer sleeve 60*a* is secured to the lower support 50. In the illustrated embodiment the pair of outer sleeves 60*d* extends along opposing tanks sidewalls 32 at least partially thereby providing lateral support of the tank 30 during movement along the paved surface. Preferably, the outer sleeves 60*d* are secured to both the tank sidewalls 32 and the lower support 50, providing additional stability to the movable frame 20.

Generally, the movable frame 20 includes the handle 60 and lower support 50. In association with operation of the handle 60, the outer sleeve 60*d* urges the lower support 50 along the paved surface for selective dispensing of the sealant from the apparatus 10. The u-shaped handle 60*c* has a generally u-shaped configuration with an extension 60*e* spanning the opposing handle sides 60*a*, 60*b* which are adapted for receipt by the pair of outer sleeves 60*d*, the extension 60*e* being spaced from the tank 30.

The first and second control members 40*a*, 40*b* generally extend horizontally along the handle extension 60*e*, the catch 62 presenting a downwardly depending arcuate hook extending inwardly from the extension 60*e* towards the tank 30 for releasable engagement of the first and second control members 40*a*, 40*b*. During receipt of the first and second control members 40*a*, 40*b* by the catch 62, the apparatus 10 is positioned in a resting mode with the spreading means 24 raised and the dispensing means 22 elevated. As the first control member 40*a* is released from the catch 62, the first control member 40*a* urges towards the tank 30, moving the dispensing means 22 downward for engagement. As the second control member 40*b* is released from the catch 62 and urged forward, the spreading means 24 is lowered towards the paved surface below.

A substantially planar guide 64 connectably extends between the opposing first and second handle sides 60*a*, 60*b*, in parallel with the extension 60*e*. The substantially planar guide 64 aligns and provides additional lateral stability for reciprocal movement of the dispenser and spreader linkage members 22*b*, 24*d* therethrough. The guide 64 has a first and second guide end 64*a*, 64*b* which are complementary shaped for placement at each side handle 64*a*, 64*b* and as depicted is generally semicircular corresponding to the illustrated handle sides 60*a*, 60*b* which are generally tubular, although they may have alternative configurations as necessary.

The lower support 50 includes a pair of upwardly angled arms 52 having a mid-sectional support at a cross member 54 and rear support at a rear sidewall 52 extending between the angled arms 52 which are operably connected to rear wheel and front wheel pairs 58*a*, 58*b*. Each of the upwardly angled arms 52 angularly extends from a rear 52*b* towards a front 52*a* with an angled region 52*c* positioned therebetween, the rear sidewall 56 extending from each arm 52 at each rear 52*b*. An angled region 52*c* of each upwardly angled arm 52 is connectably secured the outer sleeves 60*d* associated with the handle 60.

The cross member 54 is secured between the pair of angled arms 52 at a horizontal region 52*d* near the angled region 52*c* for generally planar support of the tank 30 at a cylindrical orifice underlying a generally rectangular opening 36*a* associated with the channel guide 36. The cross-member 54 includes a shaped opening 54*a* for dispensing the sealant from the tank 30 during operation of the first control member 40*a*. Depending on the desired dispensing parameters, the shaped opening 54*a* may have a greater or larger radius associated with the cylindrical orifice or an alternative shape may be used to provide additionally desired dispensing properties.

The channel guide 36 is depicted as a partial frustropyramid with sides 36*b* extending angularly from the tank sidewalls 32 to the rectangular opening 36*a* in communication with the shaped opening 54*a*. As depicted in FIG. 2D, the rear sidewall 56 extends laterally between the pair of angled arms 52 at the rear for receipt of an axle 44 associated with the rear wheel pair 58*a*. The rear wheels 58*a* are generally fixed in orientation, while being rotated about the axle, which as depicted is generally fixed and extends along the rear sidewall 58 and may include fasteners and bushings for rotation of the wheels 58*a* about the axle 44.

In operation, the movable frame can be operated in both a forward and reverse direction while allowing for rapid changes of direction such as side-to-side or turning around, while maintaining a substantially planar orientation to avoid undesired spillage of any heated sealant. To facilitate the rapid change of direction, a pair of turnable front wheels 58*b* associated with the front 52*a*, each wheel 58*b* being secured to the angled arm 52 with a control arm 66 downwardly depending therefrom. A pair of apertured receives 68 adapted for receiving each control arm 66 is associated with each angled arm 52, each apertured receiver 68 being spaced apart and adapted for rotation of the control arm 66 therein. Additionally, each control arm 66 has a plurality of elbow joints 70 presenting an offset orientation, allowing for rotation of the control arm 66 between an apparatus forward orientation in which the control arms 66 are angled towards the rear 52*b* and an apparatus rearward orientation in which the control arms 66 are angled towards the front 52*a*. In the illustrated embodiment, the control arms allow for full 360° rotation. In this manner, the wheels 58*b* are turnable about a vertical axis extending generally between the pair of apertured receivers 68, the control arm 66 being biased inwardly during forward motion and outwardly for reverse motion.

The wheels 58*a*, 58*b* generally have a contact surface extending along the perimeter of the wheel, the contact surface being preferably ¼ inch to ¾ of an inch in width. The wheels 58*a*, 58*b*, like a majority of the invention, are preferably constructed of carbon steel to allow for high temperature combustion for rapid cleaning of the sealant and allow for dispensing of high temperature sealants along the channeled guide 36 towards the paved surface.

Figure 2:
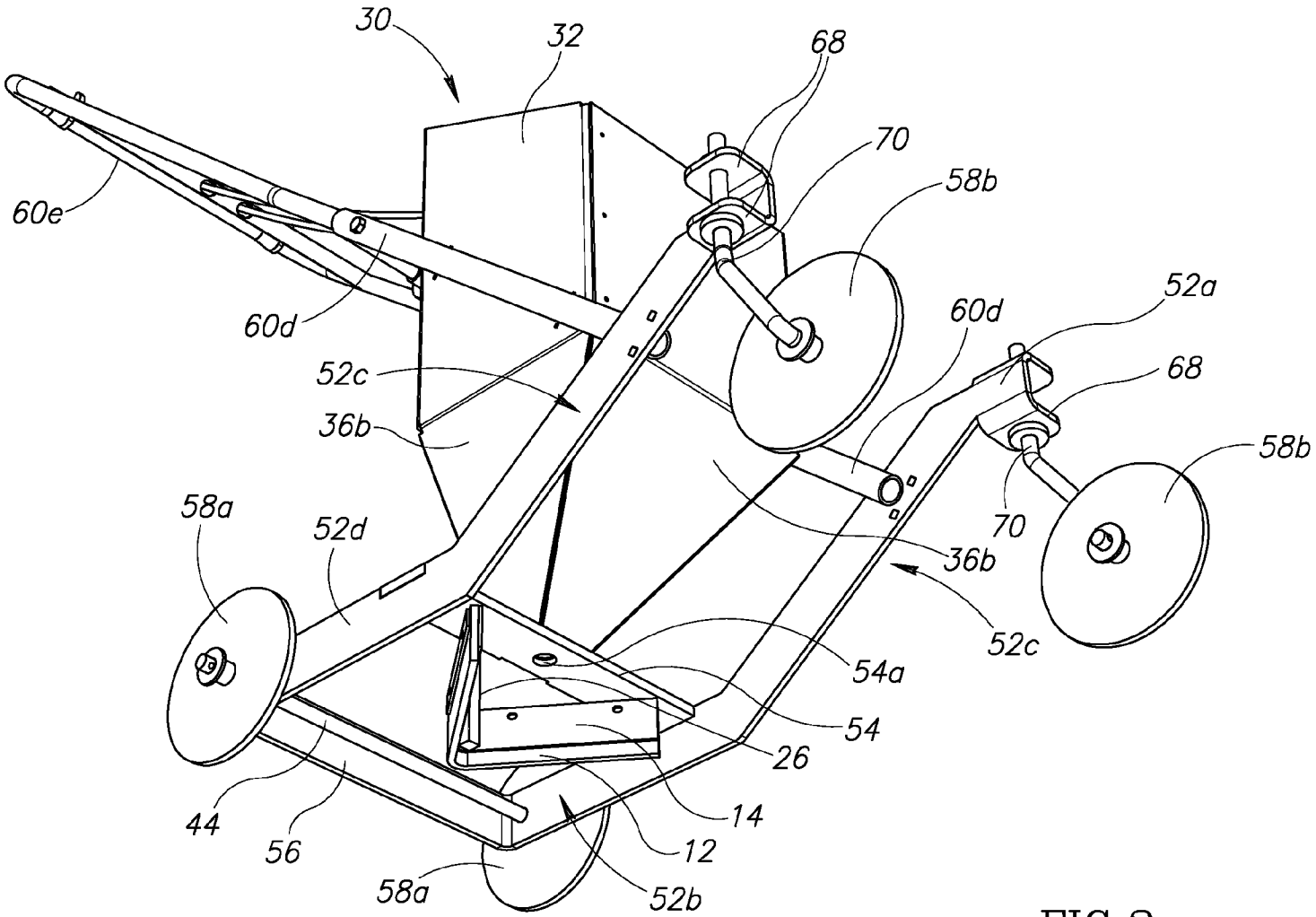
FIG. 2 is a bottom front perspective view in accordance with the embodiment of FIG. 1.
Figure 2A:
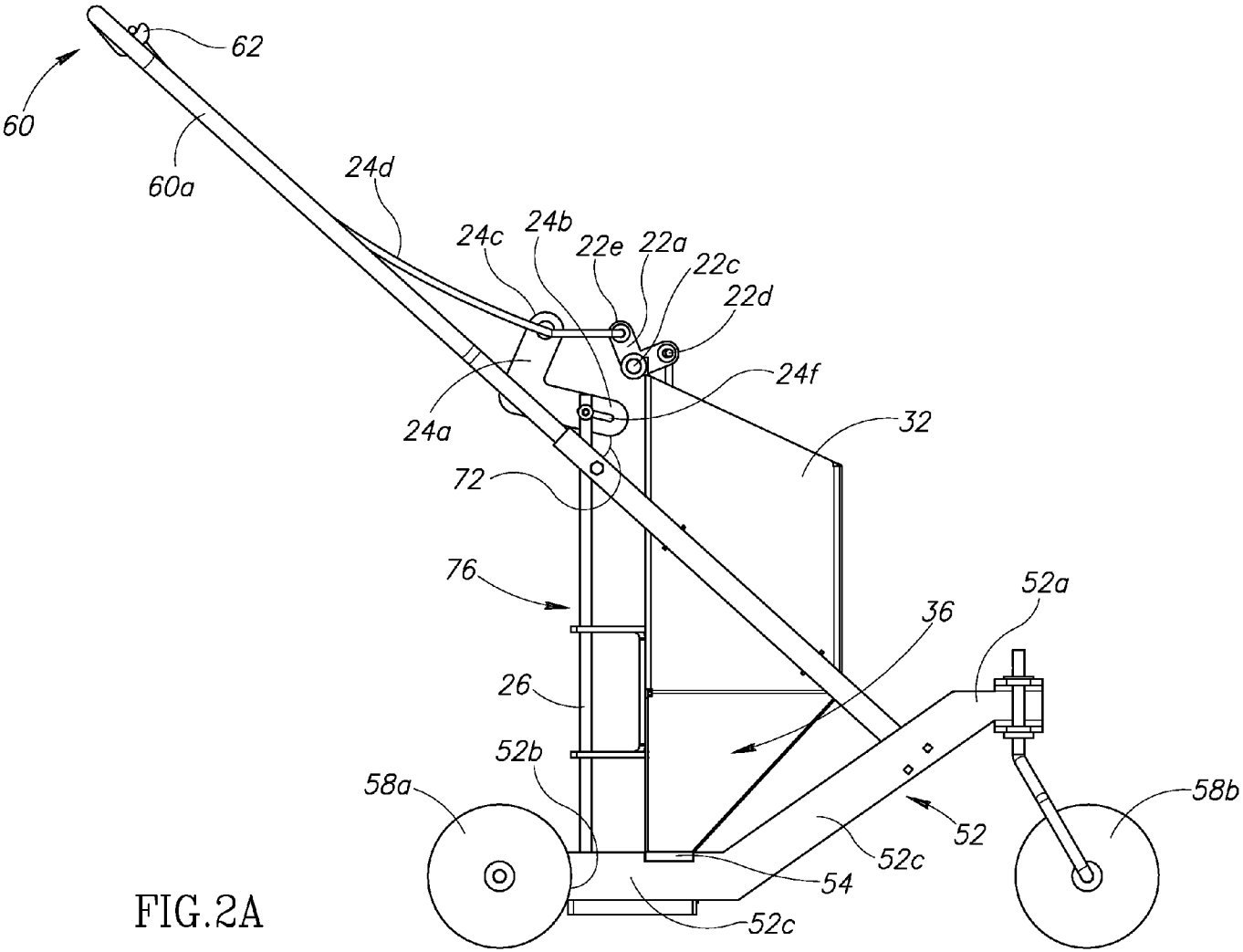
FIG. 2A is a right-side elevational view in accordance with the embodiment of FIG. 1.
Figure 2B:
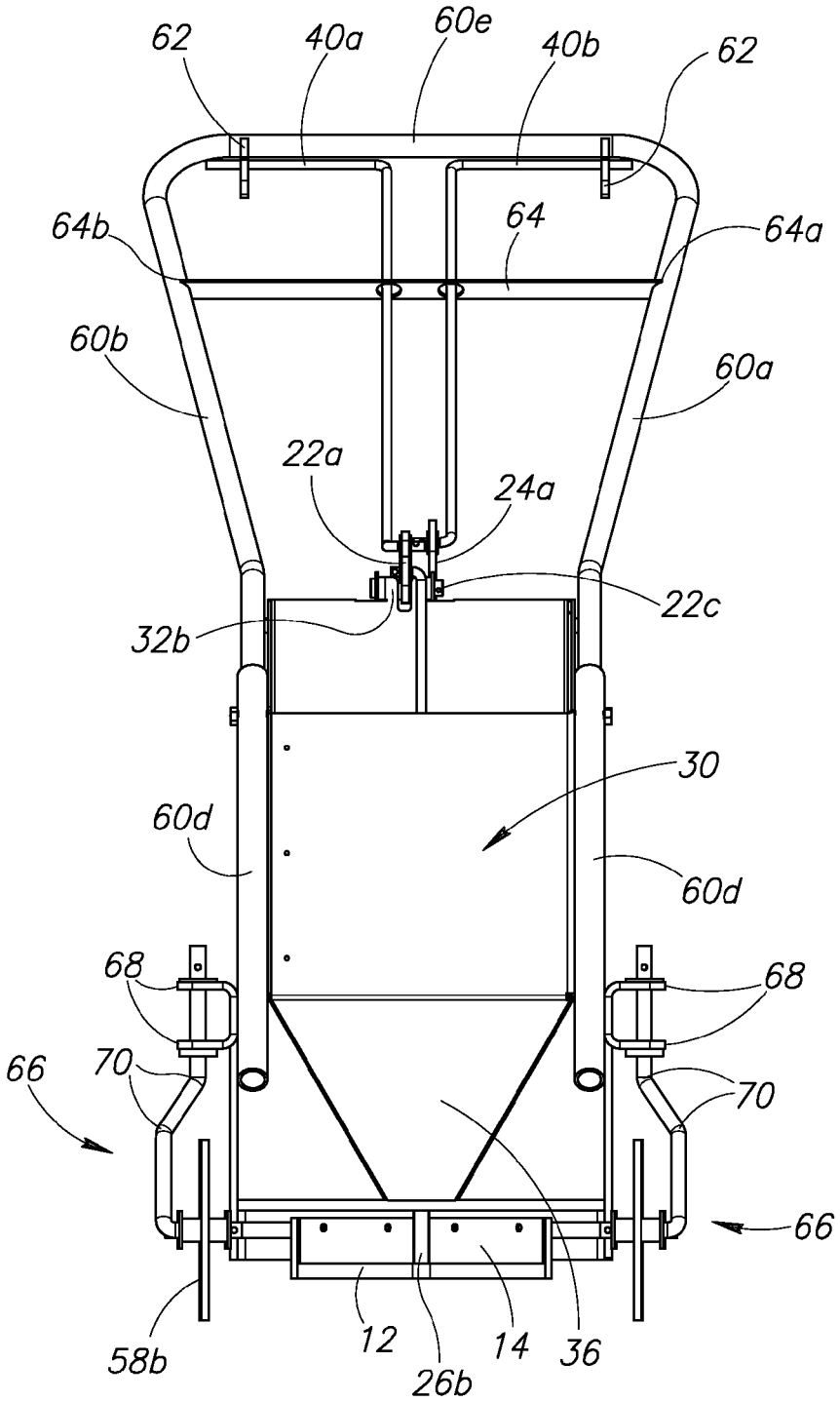
FIG. 2B is a front-elevational view in accordance with the embodiment of FIG. 1.

As is illustrated in FIG. 2A, one end of the spreading arm 24*a* may include an elongated slot 24*f* extending therethrough. The elongated slot 24*f* angularly extends from an upper to a lower fastening region for receiving an end 26*a* of the lifting rod 26. During rearward rotation of the spreading arm 24*a*, towards the reclined position, received end 26*a* associated with the lifting rod 26 travels along a variable radius arc, wherein the traveling arc of the lifting rod 26 varies according to its movement within the elongated slot 24*f* during rotation of the spreading arm 24*a* about the shaft 24*e*. An incident angle of orientation 72 is presented by the elongated slot 24*f* and the vertically extending lifting rod 26. The angle of orientation 72 increases as the received end 26*a* is rotated rearwardly, the variable arc correspondingly increasing. As the received end 26*a* is rotated downwardly and descends along the elongated slot 24*f*, the angle of orientation 72 decreasing along with a corresponding decrease of the variable arc.

Operation of the second control member 40*b* rotates the spreading arm 24*a*, engaging the received end 26*a* along an interiorly positioned circumferential wall 24*g* associated with the elongated slot 24*f*. The elongated slot 24*f* in communication with the lifting rod 26 allows for variable vertical movement of the lifting rod 26 in response to surface contours associated with the paved surface, the squeegee 12 being adapted for engagement along the varying contoured paved surface. In addition, the elongated slot 24*f* allows for variable vertical movement of the lifting rod 26, reducing the potential for undesirable lockup by a squeegee support 14 associated with a supporting end 26*b* of lifting rod 26 and adapted for receiving the squeegee 12. Generally, the lifting rod 26 is mechanically secured to the spreading arm 24*a* at the elongated slot 24*f* and the squeegee support 14, with the squeegee releasably attached thereto. Generally, the squeegee support 14 is secured to the support end 26*b* of the lifting rod 26.

During operation, compression of the second control member 40*b* raises the spreading means 24 towards a raised position. Decompression of the second control member 40*b* lowers the squeegee 12 towards the paved surface. When the second control member 40*b* is secured by the catch 62, the squeegee 12 associated with the spreading member 24 are maintained in a vertical orientation.

Figure 2C:
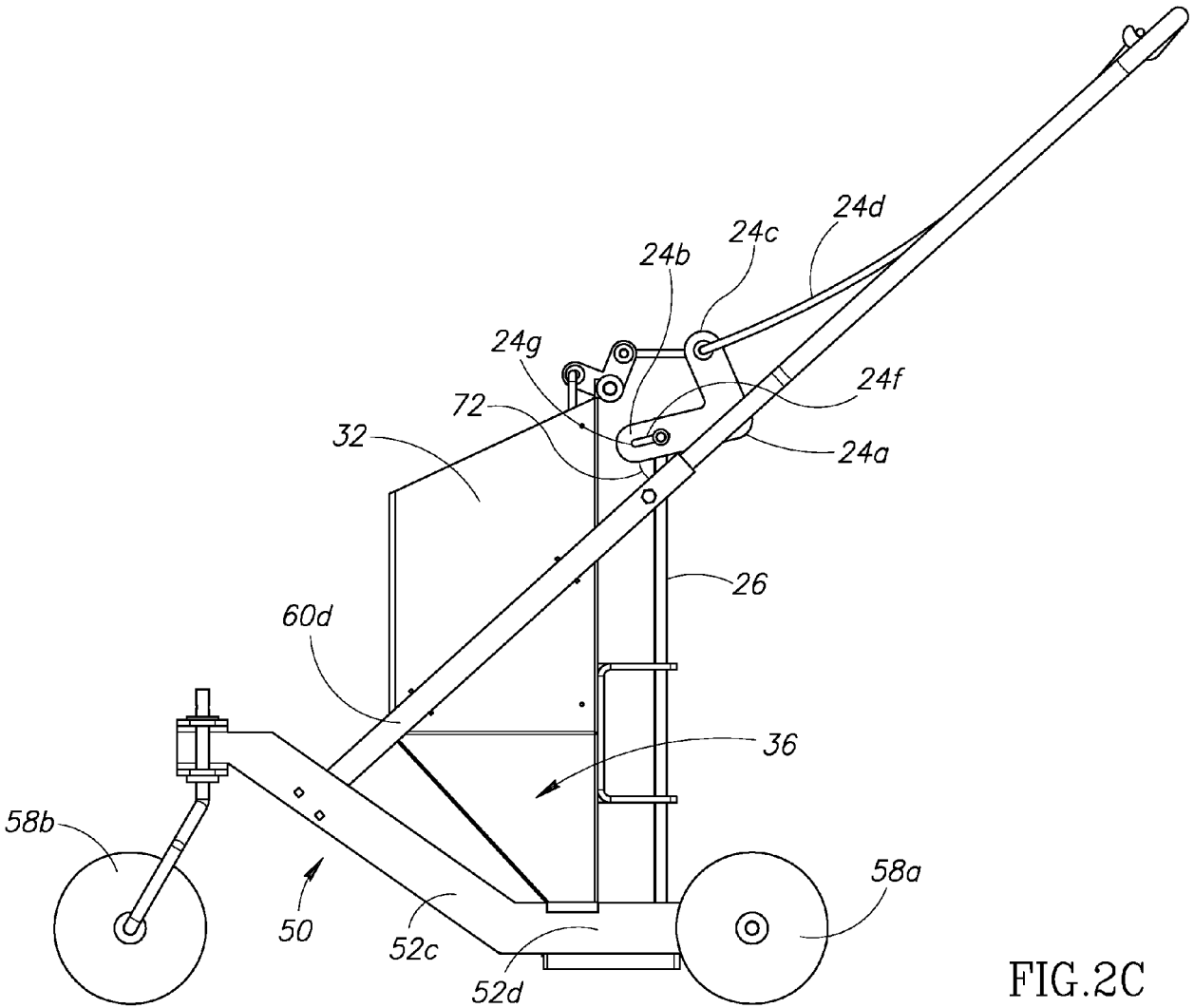
FIG. 2C is a left-side elevational view in accordance with the embodiment of FIG. 1.
Figure 2D:
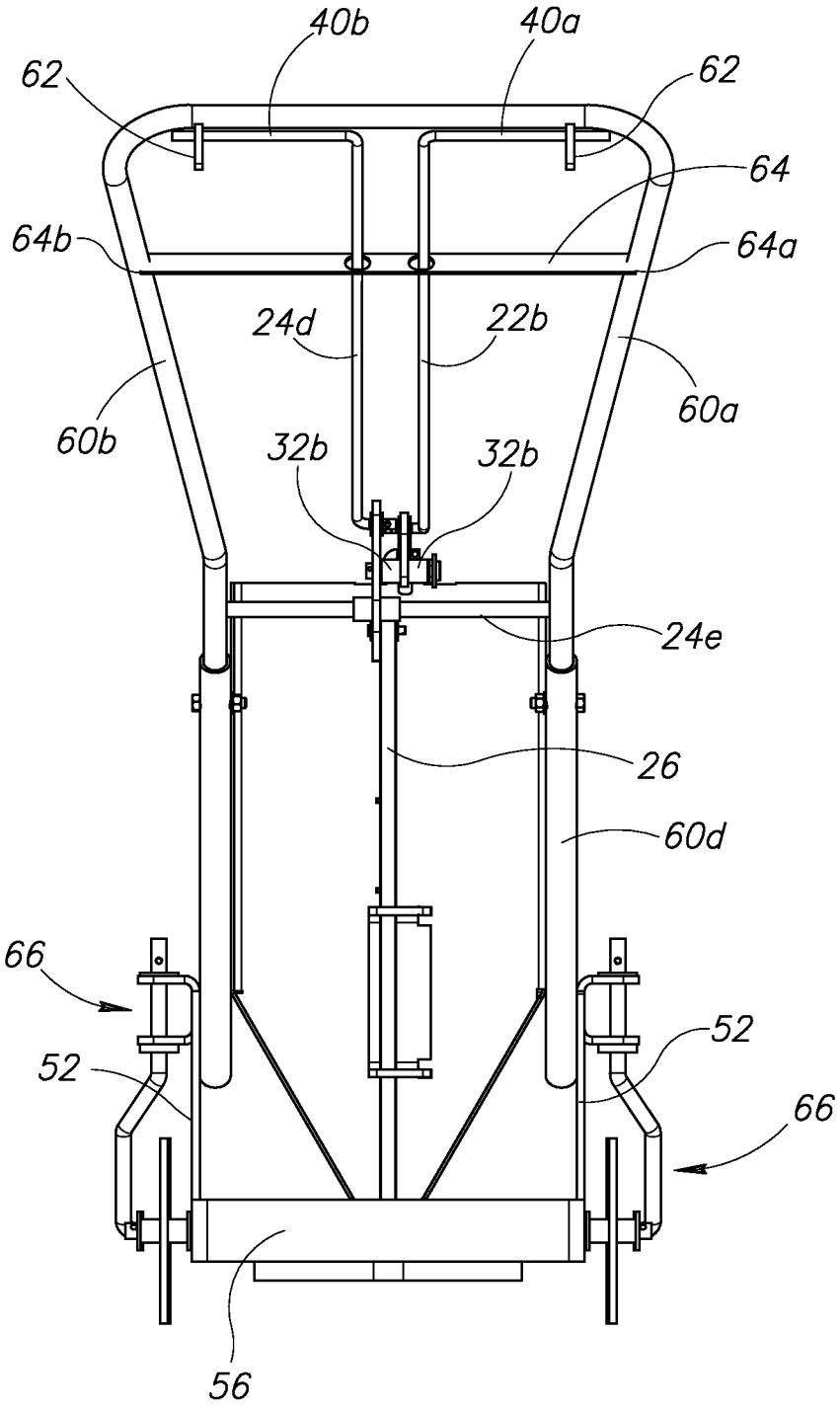
FIG. 2D is a rear elevational view in accordance with the embodiment of FIG. 1.
Figure 2E:
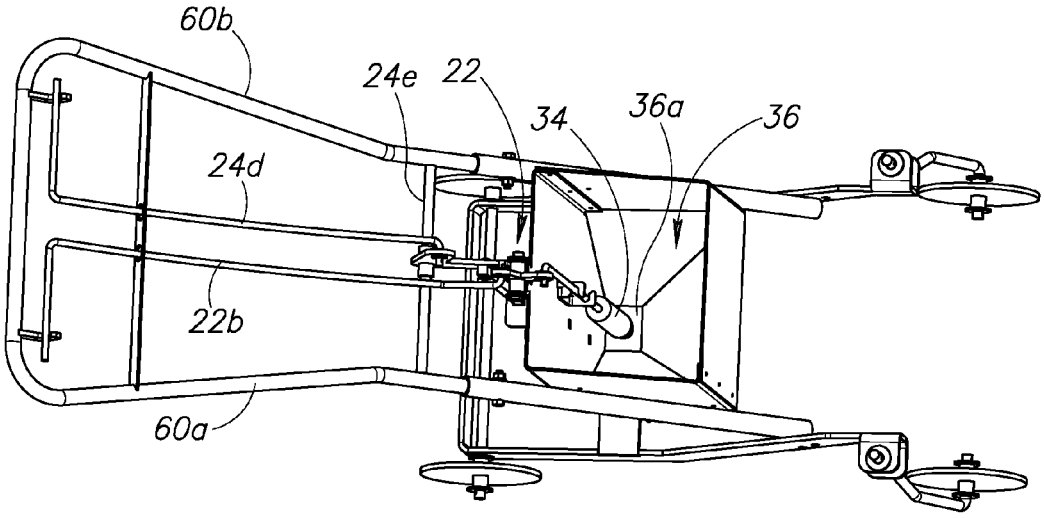
FIG. 2E is a top front perspective in accordance with the embodiment of FIG. 1.
Figure 3:
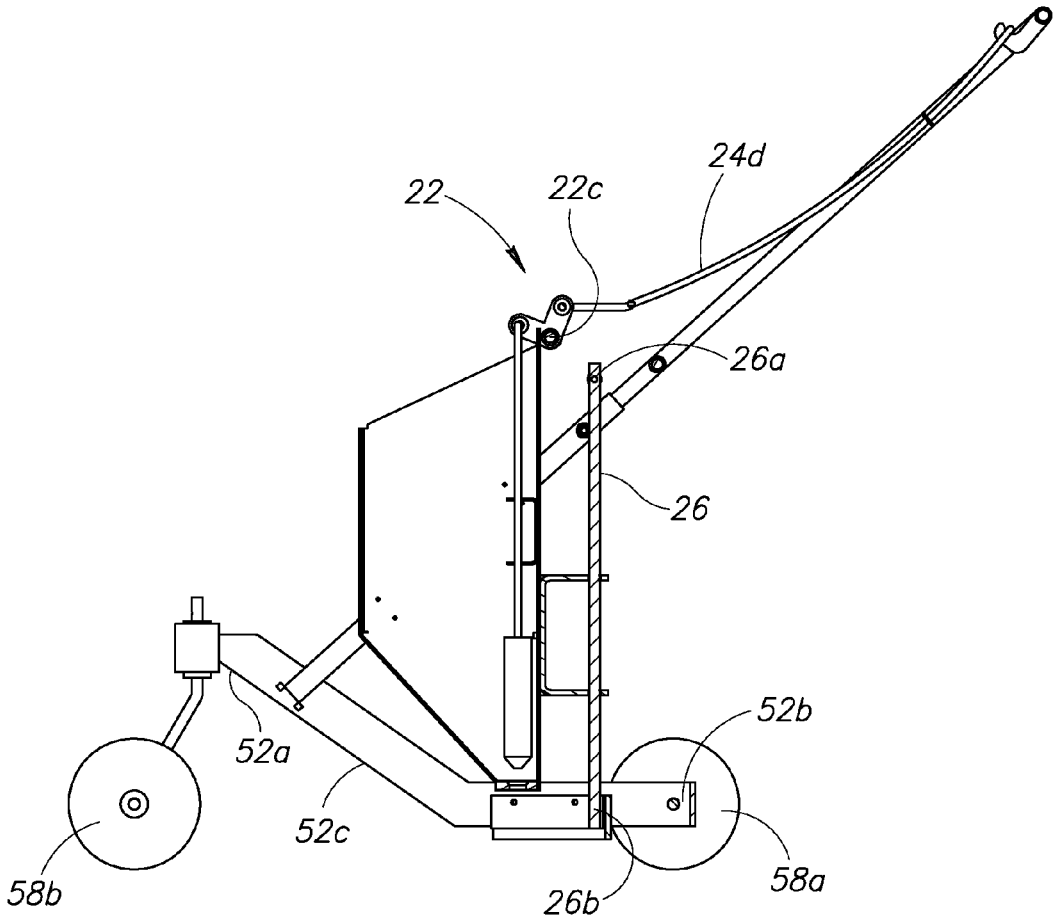
FIG. 3 is a cross section side elevational view in accordance with the embodiment of FIG. 1.

As illustrated in FIGS. 2*c* and 3, one end of the lifting rod 26 is adjustably secured through the elongated slot 24*f* with an opposite end being connectably secured to the squeegee support member 14. The lifting rod 26 extends along the rear wall 30*a*, spaced therefrom by a support bracket 76 extending rearwardly from the rear wall 30*a*, the support bracket 76 including an upper and lower support 76*a*, 76*b* providing vertical stability and support of the lifting rod 26 as it travels vertically in operation. In generally, the support bracket 76 guides the lifting rod 26 along the rear wall 30*a* and aligns the spreader means 24 during application of the sealant along the paved surface.

As depicted in FIG. 2D, the lifting rod 26 and support bracket 76 have complementary angular configuration for alignment, the support bracket 76 including an angular receiver (not shown) for securely receiving the angled surface associated with the lifting rod 26, the angled receiver engaging the angled surface for alignment of the spreader means 24 during operation of the apparatus 10. As illustrated, the lifting rod 26 is a rectangular and the upper and lower support brackets 76*a*, 76*b* having complementary receiving surfaces for receipt of the angled surfaces associated with the lifting rod 26. Upper and lower brackets 76*a*, 76*b* present an axis of travel along which the lifting rod 26 generally travels during operation. While the illustrated lifting rod 26 is rectangular, it may include a variety of angled surfaces for receipt by the complementary configured support bracket 76 for limiting rotational movement and alignment of the squeegee 12 during spreading of the sealant upon the paved surface. In an optional embodiment, the support bracket 76 is connected to the rear wall 30*a* at a notch associated with each of the upper and lower support bracket 76*a*, 76*b* as is illustrated in FIG. 2D.

Figure 2F:
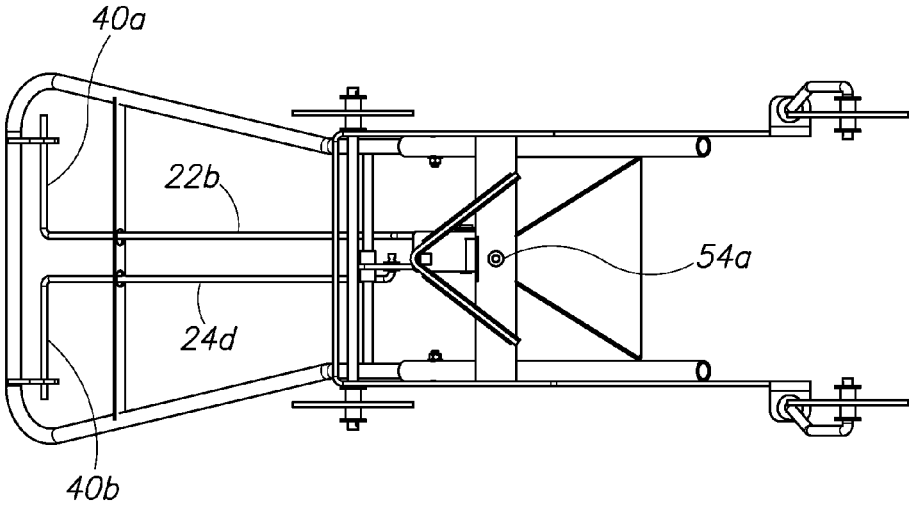
FIG. 2F is a bottom plan view in accordance with the embodiment of FIG. 1.

FIG. 2B illustrates the handle 60 extending along opposite sidewalls 32, the handle 60 generally consisting of a hollow tubular structure adapted for telescopic movement. In addition, the wheels 58*a*, 58*b* include adequate bushings along with appropriate bearing surfaces for desired rotational movement. FIG. 2D illustrates the rear sidewall 56 positioned between the pair of rear wheels 58*a* the axle 44 extending therealong, the rear sidewall 56 supporting and protecting the axle 44 and providing rear support for the moveable frame 20. FIG. 2F illustrates the shaped opening 54*a* associated with the cross member 54.

In operation the user will assemble the apparatus 10 in accordance with standard assembly techniques, including mechanical fasteners and where appropriate welding. Where practical, the present invention will be fabricated from carbon steel. In the stored configuration the catch 62 is in receipt of the first and second control members 40*a*, 40*b*. When ready for use, the first control member 40*a* will be released from the catch 62 and the tank will be filled with a preferably heated sealant. The apparatus 10 is then selectively positioned along the paved surface and the second control member 40*b* is released from the catch 62. The apparatus 10 being orientated in a forward direction, the front wheels 58*b* being rotated rearwardly as the control arms 66 rotate inwardly. Once the apparatus 10 is properly positioned, the first control member 40*a* is selectively compressed thereby rotating the dispensing arm 22*a* towards the reclined position, causing the plunger 34 to climb vertically, through the guide members 34*a*, 34*b*, allowing the sealant to desirably travel through the tank 30, the channeled guide 36, through the shaped opening 54*a* towards the paved surface. The second control member 40*b* is adapted for proper positioning and operation of the spreading means 24 in relation to the paved surface, the tank 30 and the lower support 50.

Generally, the second control member 40*b* is biased downwardly for engagement of the squeegee 12 upon the paved surface. During operation decompression of the second control member 40*b*, the spreading arm 22*a* will rotate forwardly, lowering the lifting rod 26 along the rear wall 30*a* of the tank 30 as it travels through the support bracket 76, lowering the squeegee 12 in a horizontal orientation providing downwardly pressure at the paved surface for spreading the dispensed sealant upon the paved surface.

Operation of the first control member 40*a*, compressionially, will rotate the dispensing arm 24*a* rearwardly, elevating the plunger 34 from the rectangular opening 36*a* of the channel guide 36. As the plunger 34 elevates, a plunger linkage member 35 connectably secured between the dispensing arm 22*a* and the plunger 34 travels through the slotted opening 34*d* associated with the plunger guides 34*a*, 34*b*. Selective decompression of the first control member lowers the plunger 34 for volumetric control of the dispensed sealant from the apparatus 10 towards the paved surface. Once the desired volume of sealant is achieved the apparatus 10 is selectively guided along the paved surface until completed. Once the sealant has been dispensed and spread by the apparatus 10, the first control arm 40*a* may be released, inclining the dispensing arm 22*a* forward, allowing the plunger 42 to descend towards the channel guide 36, the plunger 42 being aligned for engagement at the shaped opening 54*a* by the plunger guides 34*a*, 34*b*. When the second control arm 40*b* is compressed, the spreading arm 24*a* is rotated rearwardly and the lifting rod 26 travels upwardly along the rear wall 30*a* through support bracket 76, the angled surface angled surface being engaged by the receiving surface associated with the support bracket 76, raising the squeegee 12. The device 10 is then selectively repositioned as needed.

The preferred forms of the invention described above are to be used as illustration only, and should not be utilized in a limiting sense in interpret the scope of the present invention. Obvious modifications to the exemplary embodiments, as herein set forth, could be readily made by those skilled in the art without depart from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed and desired to be secured by Letters Patent:

1. A combination sealant dispensing and spreading apparatus for selectively dispensing and spreading sealant upon a paved surface said apparatus comprising:

a moveable frame having a handle extending angularly towards a lower support;

a sealant tank having a sidewall extending downwardly toward a channeled guide and in operation with a dispensing means;

said lower support operably connected to a V-shaped spreading means;

said handle having a pair of operators a first handle operator and a second handle operator, said first handle operator in communication with the dispensing means and said second handle operator in communication with the spreading means;

wherein said dispensing means includes a plunger extending downwardly from a dispensing arm towards the channeled guide for engagement at a shaped opening;

said second handle operator in communication with said V-shaped spreading means at a spreading arm;

a pair of plunger guides which align said plunger along a sidewall of said tank;

each of said plunger guides including a pair of tabs for slidable receipt of said dispensing means between an engaging and elevated position;

said dispensing arm having a centrally located dispensing shaft spanning a pair of vertical supports, said vertical support pair extending from an upper lip of the tank sidewall;

said moveable frame further including a cross member spanning between a pair of angled arms connected to said handle;

said cross member including the shaped opening for fluidic communication between said tank and said spreading means;

said sealant traveling through said channeled guide upon operation of said dispensing means for dispensing said sealant from said tank to the paved surface;

a front and rear wheel pair, each of said front wheel being secured to said pair of angled arms with a rotatable control arm having at least one elbow joint;

said first handle operator being biased for retaining the sealant within said sealant tank and when operated, said first handle operator selectively releases the sealant from said tank; and said second handle operator being biased for engagement of said spreading means with said paved surface for spreading the sealant dispensed from said tank upon the paved surface.

2. The combination of claim 1 wherein said rotatable control arm rotates fully.

3. The combination of claim 1 wherein said plunger extending downwardly from said dispensing arm towards the channeled guide for selective release of the sealant to the paved surface during operation of said first handle operator.

4. The combination of claim 1 wherein each of said tabs presents a slotted opening for slidable receipt of a dispensing linking member between the dispensing arm and the plunger.

5. The combination of claim 1 wherein said V-shaped spreading means further includes a squeegee secured to a lifting rod whereby operation of said second handle operator raises and lowers said squeegee in relation to the paved surface.

6. The combination of claim 1 wherein said first and second handle operators are configured to be operated simultaneously to spread said dispersed sealant from said tank while moving said frame wherein said first handle operator lowers said spreading means and said second handle operator elevates said dispensing means.

7. The combination of claim 1 wherein each of said pair of operators is secured by a catch extending from said handle.

8. The combination of claim 1 wherein said control arm is inwardly biased.

9. The combination of claim 8 wherein said first and second handle operators are configured to be operated simultaneously to spread said dispersed sealant from said tank while moving said frame wherein said first handle operator lowers said spreading means and said second handle operator elevates said dispensing means.

10. The combination of claim 8 wherein each of said control arm is inwardly biased.

* * * * *